US010526921B2

(12) United States Patent
Taxacher et al.

(10) Patent No.: US 10,526,921 B2
(45) Date of Patent: Jan. 7, 2020

(54) ANTI-ROTATION SHROUD DAMPENING PIN AND TURBINE SHROUD ASSEMBLY

(71) Applicant: GENERAL ELECTRIC COMPANY, Schenectady, NY (US)

(72) Inventors: Glenn Curtis Taxacher, Simpsonville, SC (US); John McConnell Delvaux, Fountain Inn, SC (US); Matthew Troy Hafner, Honea Path, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 252 days.

(21) Appl. No.: 15/623,938

(22) Filed: Jun. 15, 2017

(65) Prior Publication Data

US 2018/0363504 A1 Dec. 20, 2018

(51) Int. Cl.
*F01D 9/04* (2006.01)
*F01D 25/24* (2006.01)

(52) U.S. Cl.
CPC ..... *F01D 25/246* (2013.01); *F01D 9/04* (2013.01); *F05D 2260/30* (2013.01); *F05D 2300/175* (2013.01); *F05D 2300/6033* (2013.01)

(58) Field of Classification Search
CPC ..... F01D 9/04; F01D 25/246; F05D 2260/30; F05D 2300/175; F05D 2300/6033
See application file for complete search history.

(56) References Cited

U.S. PATENT DOCUMENTS 5,618,161 A * 4/1997 Papageorgiou ..... F01D 9/042 415/190
6,315,519 B1 11/2001 Bagepalli et al.
6,726,448 B2 4/2004 McGrath et al.
6,758,653 B2 7/2004 Morrison
6,942,203 B2 9/2005 Schroder et al.
(Continued)

FOREIGN PATENT DOCUMENTS

EP 1529926 A2 5/2005
EP 2299061 A2 3/2011

OTHER PUBLICATIONS

Taxacher, et al: "Turbine Component" filed on Aug. 18, 2014 as U.S. Appl. No. 14/461,551 (unpublished application).

*Primary Examiner* — Igor Kershteyn
(74) *Attorney, Agent, or Firm* — McNees Wallace & Nurick LLC

(57) ABSTRACT

An anti-rotation shroud dampening pin is disclosed including a shaft, an anti-rotation dampening tip at a first end of the shaft, and a cap at a second end of the shaft. The anti-rotation dampening tip includes a pin non-circular cross-section. A turbine shroud assembly is disclosed, including an inner shroud, an outer shroud, the anti-rotation shroud dampening pin, and a biasing apparatus. The inner shroud includes an anti-rotation depression having a depression non-circular cross-section. The outer shroud includes a channel extending from an aperture adjacent to the inner shroud. The anti-rotation shroud dampening pin is disposed within the channel and in contact with the inner shroud, and extends through the aperture into the anti-rotation depression. The biasing apparatus contacts the cap and provides a biasing force to the inner shroud through the anti-rotation dampening tip. The pin non-circular cross-section mates non-rotatably into the depression non-circular cross-section.

16 Claims, 3 Drawing Sheets

(56) References Cited

U.S. PATENT DOCUMENTS

| | | | | |
|---|---|---|---|---|
| 6,971,847 | B2 * | 12/2005 | Tiemann | F01D 9/042 403/230 |
| 8,047,773 | B2 | 11/2011 | Bruce et al. | |
| 8,167,546 | B2 | 5/2012 | Shi et al. | |
| 2008/0199312 | A1 * | 8/2008 | Chekanov | F01D 5/18 415/209.3 |
| 2010/0031906 | A1 * | 2/2010 | Cuatt | F01L 1/3442 123/90.17 |
| 2011/0163506 | A1 * | 7/2011 | Hafner | F01D 5/08 277/309 |
| 2011/0293412 | A1 * | 12/2011 | Afanasiev | F01D 9/042 415/208.1 |
| 2012/0114490 | A1 * | 5/2012 | Joshi | F01D 5/303 416/220 R |
| 2014/0248140 | A1 * | 9/2014 | Jacques | F01D 9/042 415/183 |
| 2016/0025013 | A1 * | 1/2016 | Miller | F02C 7/28 60/805 |
| 2017/0044923 | A1 | 2/2017 | Roberts et al. | |
| 2017/0051627 | A1 | 2/2017 | Hafner et al. | |

* cited by examiner

ANTI-ROTATION SHROUD DAMPENING PIN AND TURBINE SHROUD ASSEMBLY

FIELD OF THE INVENTION

The present invention is directed to shroud dampening pins and turbine shroud assemblies. More particularly, the present invention is directed to shroud dampening pins and turbine shroud assemblies wherein the shroud dampening pin includes an anti-rotation dampening tip.

BACKGROUND OF THE INVENTION

Hot gas path components of gas turbines are subjected to high air loads and high acoustic loads during operation which, combined with the elevated temperatures and harsh environments, may damage the components over time. Both metal and ceramic matrix composite ("CMC") components may be vulnerable to such damage, although CMC components are typically regarded as being more susceptible than metallic counterparts, particularly where CMC components are adjacent to metallic components.

Damage from air loads and acoustic loads may be pronounced in certain components, such as turbine shrouds, which include a hot gas path-facing sub-component which is not fully secured to, but in contact with, a non-hot gas path-facing sub-component. By way of example, due to air loads and acoustic loads, the inner shroud of a turbine shroud assembly may vibrate against and be damaged by the outer shroud during operation. Additionally, inner shrouds may rotate relative to the outer shrouds during operation.

BRIEF DESCRIPTION OF THE INVENTION

In an exemplary embodiment, an anti-rotation shroud dampening pin includes a shaft, an anti-rotation dampening tip disposed at a first end of the shaft, and a cap disposed at a second end of the shaft distal from the first end of the shaft. The anti-rotation dampening tip includes a pin non-circular cross-section.

In another exemplary embodiment, a turbine shroud assembly includes an inner shroud, an outer shroud, an anti-rotation shroud dampening pin, and a biasing apparatus. The inner shroud is arranged to be disposed adjacent to a hot gas path, and includes an anti-rotation depression. The anti-rotation depression includes a depression non-circular cross-section. The outer shroud is adjacent to the inner shroud and arranged to be disposed distal from the hot gas path across the inner shroud. The outer shroud includes a channel extending from an aperture adjacent to the inner shroud. The anti-rotation shroud dampening pin is disposed within the channel and in contact with the inner shroud. The anti-rotation shroud dampening pin includes a shaft, and anti-rotation dampening tip, and a cap. The shaft is disposed within the channel. The anti-rotation dampening tip is disposed at a first end of the shaft and extends through the aperture into the anti-rotation depression of the inner shroud. The anti-rotation dampening tip includes a pin non-circular cross-section. The cap is disposed at a second end of the shaft distal from the first end of the shaft. The biasing apparatus is in contact with the cap and provides a biasing force away from the outer shroud along the anti-rotation shroud dampening pin to the inner shroud through the anti-rotation dampening tip. The pin non-circular cross-section mates non-rotatably into the depression non-circular cross-section.

Other features and advantages of the present invention will be apparent from the following more detailed description of the preferred embodiment, taken in conjunction with the accompanying drawings, which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Provided are exemplary anti-rotation shroud dampening pins and turbine shroud assemblies. Embodiments of the present disclosure, in comparison to articles not utilizing one or more features disclosed herein, decrease costs, improve mechanical properties, increase component life, decrease maintenance requirements, inhibit or prevent inner shroud rotation, inhibit or prevent pin rotation, decrease pin shearing, or combinations thereof.

Figure 1:
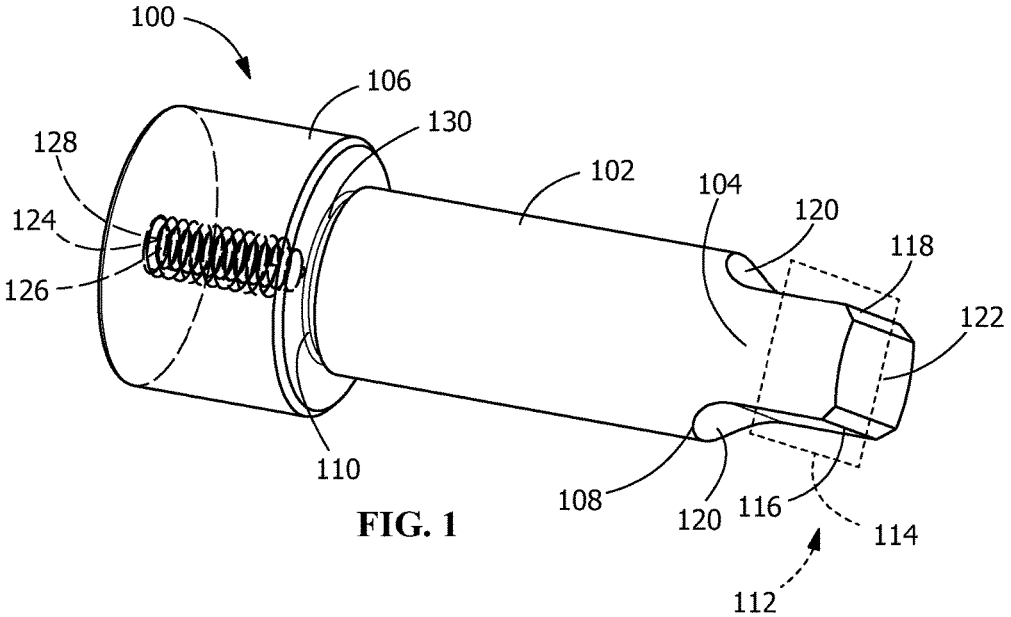
FIG. 1 is a perspective view of a shroud dampening pin, according to an embodiment of the present disclosure.

Referring to FIG. 1, in one embodiment, an anti-rotation shroud dampening pin 100 includes a shaft 102, an anti-rotation dampening tip 104, and a cap 106. The anti-rotation dampening tip 104 is disposed at a first end 108 of the shaft 102. The cap 106 is disposed at a second end 110 of the shaft 102 distal from the first end 108 of the shaft 102. The anti-rotation dampening tip 104 includes a pin non-circular cross-section 112.

The pin non-circular cross-section 112 may include any suitable conformation, including, but not limited to an ellipse, a triangle, a square, a rectangle 114, a pentagon, a hexagon, rounded variants thereof, and combinations thereof. In one embodiment, the anti-rotation dampening tip 104 includes a first contact surface 116, wherein the first contact surface 116 is essentially planar. In a further embodiment, the anti-rotation dampening tip 104 includes a second contact surface 118, wherein the second contact surface 118 is essentially planar. As used herein, "essentially planar" indicates that the surface is planar, excepting de minimus surface imperfections, textures, and distortions.

The anti-rotation shroud dampening pin 100 may transition directly from the shaft 102 to the anti-rotation dampening tip 104 (not shown) or may include a tapered portion 120 connecting the shaft 102 to the anti-rotation dampening tip 104. In one embodiment, the anti-rotation dampening tip 104 tapers from the pin non-circular cross-section 112 to a shroud contact surface 122.

The cap 106 may include an extraction interface 124. In one embodiment, the extraction interface 124 includes a bore 126. The bore 126 may be a threaded bore 128 or may include any suitable securing feature for a tool to exert a pulling force upon.

In one embodiment, the shaft 102 includes a circumferential relief groove 130 directly adjacent to the cap 106.

The anti-rotation shroud dampening pin 100 may include any suitable material composition, including, but not limited to, high alloy steels, CrMo steels, superalloys, nickel-based superalloys, cobalt-based superalloys, cobalt L-605, CRUCIBLE 422, INCONEL 718, INCONEL X-750, or combinations thereof.

As used herein, "high alloy steel" refers to a steel that, in additional to carbon, iron is alloyed with at least, by weight, about 4% additional elements, alternatively at least about 8% additional elements. Suitable additional elements include, but are not limited to, manganese, nickel, chromium, molybdenum, vanadium, silicon, boron, aluminum, cobalt, cerium, niobium, titanium, tungsten, tin, zinc, lead, and zirconium.

As used herein, "cobalt L-605" refers to an alloy including a composition, by weight, of about 20% chromium, about 10% nickel, about 15% tungsten, about 0.1% carbon, about 1.5% manganese, and a balance of cobalt. Cobalt L-605 is available from Special Metals Corporation, 3200 Riverside Drive, Huntington, W. Va. 25720.

As used herein, "CrMo steel" refers to a steel alloyed with at least chromium and molybdenum. In one embodiment, the CrMo steels are 41xx series steels as specified by the Society of Automotive Engineers.

As used herein, "CRUCIBLE 422" refers to an alloy including a composition, by weight, of about 11.5% chromium, about 1% molybdenum, about 0.23% carbon, about 0.75% manganese, about 0.35% silicon, about 0.8% nickel, about 0.25% vanadium, and a balance of iron. CRUCIBLE 422 is available from Crucible Industries LLC, 575 State Fair Boulevard, Solvay, N.Y., 13209.

As used herein, "INCONEL 718" refers to an alloy including a composition, by weight, of about 19% chromium, about 18.5% iron, about 3% molybdenum, about 3.6% niobium and tantalum, and a balance of nickel. INCONEL 718 is available from Special Metals Corporation, 3200 Riverside Drive, Huntington, W. Va. 25720.

As used herein, "INCONEL 738" refers to an alloy including a composition, by weight, of about 0.17% carbon, about 16% chromium, about 8.5% cobalt, about 1.75% molybdenum, about 2.6% tungsten, about 3.4% titanium, about 3.4% aluminum, about 0.1% zirconium, about 2% niobium, and a balance of nickel.

As used herein, "INCONEL X-750" refers to an alloy including a composition, by weight, of about 15.5% chromium, about 7% iron, about 2.5% titanium, about 0.7% aluminum, and about 0.5% niobium and tantalum, and a balance of nickel. INCONEL X-750 is available from Special Metals Corporation, 3200 Riverside Drive, Huntington, W. Va. 25720.

Referring to FIGS. 2-5, in one embodiment, a turbine shroud assembly 200 includes an inner shroud 202, an outer shroud 204, an anti-rotation shroud dampening pin 100, and a biasing apparatus 206. The inner shroud 202 is arranged to be disposed adjacent to a hot gas path 208. The outer shroud 204 is adjacent to the inner shroud 202 and arranged to be disposed distal from the hot gas path 208 across the inner shroud 202. The outer shroud 204 includes a channel 210 extending from an aperture 212 adjacent to the inner shroud 202. The anti-rotation shroud dampening pin 100 is disposed within the channel 210 and in contact with the inner shroud 202. The shaft 102 is disposed within the channel 210, and the anti-rotation dampening tip 104 of the shroud dampening pin 100 extends through the aperture 212. The biasing apparatus 206 is in contact with the cap 106 and provides a biasing force 214 away from the outer shroud 204 along the anti-rotation shroud dampening pin 100 to the inner shroud 202 through the anti-rotation dampening tip 104. The inner shroud 202 includes an anti-rotation depression 216, and the anti-rotation depression 216 includes a depression non-circular cross-section 218. The anti-rotation dampening tip 104 extends into the anti-rotation depression 216. The pin non-circular cross-section 112 mates non-rotatably into the depression non-circular cross-section 218. The turbine shroud assembly 200 may include a plurality of shroud dampening pins 100 disposed within a plurality of channels 210.

The depression non-circular cross-section 218 may include any suitable conformation, including, but not limited to an ellipse, a triangle, a square, a rectangle, a pentagon, a hexagon, rounded variants thereof, and combinations thereof. In one embodiment, the anti-rotation depression 216 includes a first mating surface 220, wherein the first mating surface 220 is essentially planar and is fitted against a first contact surface 116 of the anti-rotation dampening tip 104. In a further embodiment, the anti-rotation depression 216 includes a second mating surface 222, wherein the second mating surface 222 is essentially planar and is fitted against a second contact surface 118 of the anti-rotation dampening tip 104.

The inner shroud 202 may include any suitable material composition, including, but not limited to, CMCs, aluminum oxide-fiber-reinforced aluminum oxides (Ox/Ox), carbon-fiber-reinforced silicon carbides (C/SiC), silicon-carbide-fiber-reinforced silicon carbides (SiC/SiC), carbon-fiber-reinforced silicon nitrides ($C/Si_3N_4$), silicon-carbide-fiber-reinforced silicon nitrides ($SiC/Si_3N_4$), superalloys, nickel-based superalloys, cobalt-based superalloys, INCONEL 718, INCONEL X-750, cobalt L-605, or combinations thereof.

The outer shroud 204 may include any suitable material composition, including, but not limited to, iron alloys, steels, stainless steels, carbon steels, nickel alloys, superalloys, nickel-based superalloys, INCONEL 738, cobalt-based superalloys, or combinations thereof.

In one embodiment, the biasing force 214 is sufficient to dampen or eliminate contact and stresses between the inner shroud 202 and the outer shroud 204 generated by air loads and acoustic loads from the hot gas path 208 during operation.

The anti-rotation dampening tip 104 may inhibit or eliminate circumferential motion of the inner shroud 202, rotation of the anti-rotation shroud dampening pin 100, or both.

Figure 2:
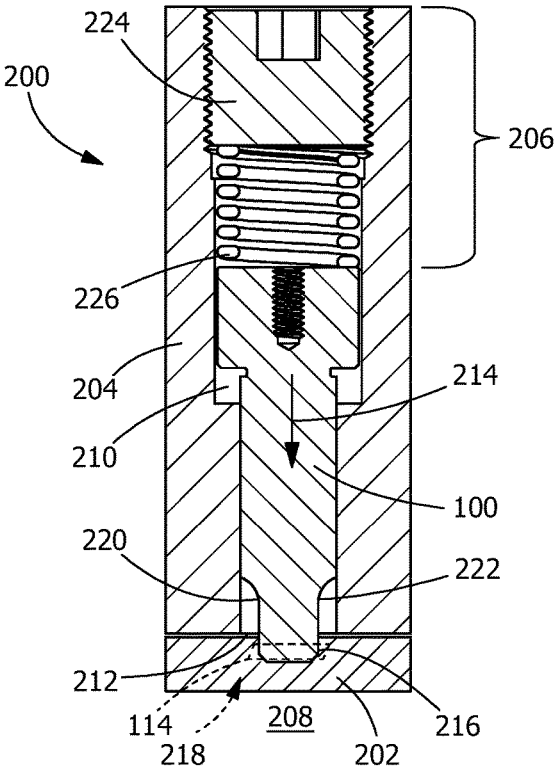
FIG. 2 is a cross-sectional view of a turbine shroud assembly having a spring, according to an embodiment of the present disclosure.

Referring to FIG. 2, the biasing apparatus 206 may be any suitable apparatus capable of providing the biasing force 214 through the anti-rotation shroud dampening pin 100 to the inner shroud 202. In one embodiment, the biasing apparatus 206 includes a plug 224 disposed in the channel 210, and a spring 226 disposed in the channel 210 between the plug 224 and the cap 106. The plug 224 compresses the spring 226, exerting the biasing force 214. The plug 224 may be threaded into the channel 210 to provide adjustability to the compression of the spring 226 and the biasing force 214. As used herein, "spring" 226 is a spring coil.

Figure 3:
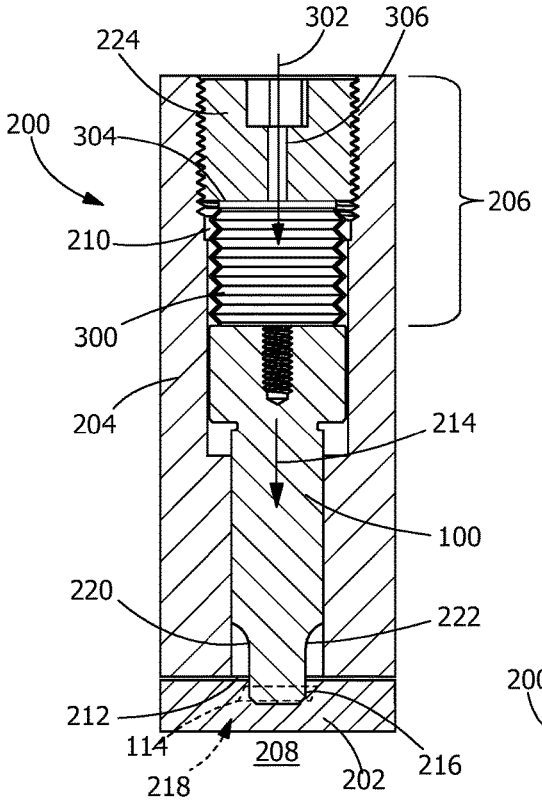
FIG. 3 is a cross-sectional view of a turbine shroud assembly having a bellows, according to an embodiment of the present disclosure.
Figure 4:
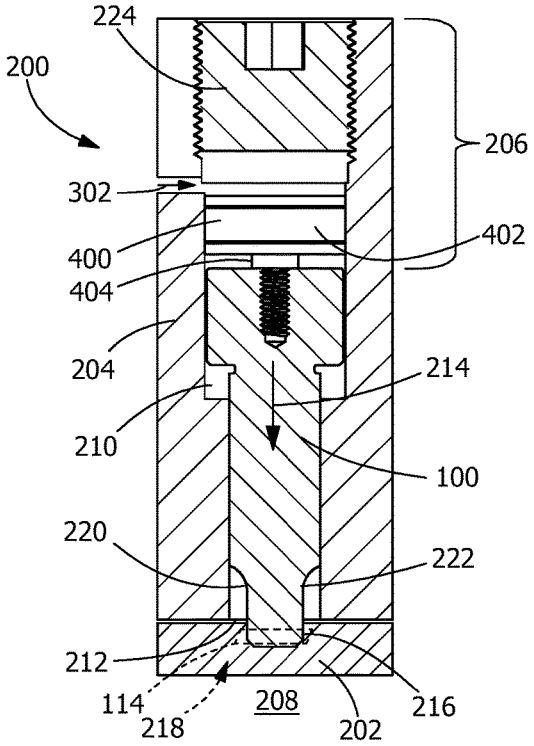
FIG. 4 is a cross-sectional view of a turbine shroud assembly having a thrust piston, according to an embodiment of the present disclosure.
Figure 5:
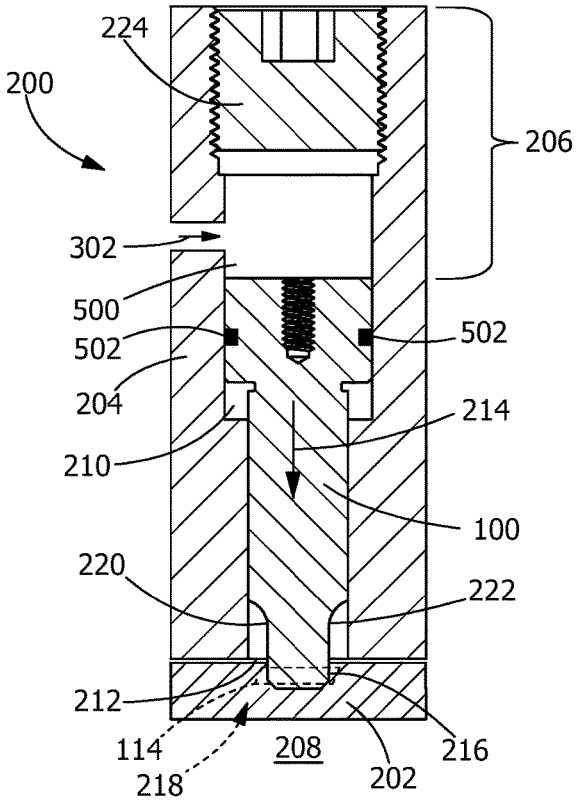
FIG. 5 is a cross-sectional view of a turbine shroud assembly having a pressurized cavity, according to an embodiment of the present disclosure.

Referring to FIGS. 3-5, the biasing apparatus 206 may be a springless biasing apparatus. As using herein, "springless" indicates the lack of a spring coil. In one embodiment, the biasing apparatus 206 is driven by a pressurized fluid 302 either in addition to or in lieu of a spring 226. The pressurized fluid 302 may be adjustable.

Referring to FIG. 3, in one embodiment, the biasing apparatus 206 includes at least one bellows 300 configured to expand in response to an increased internal pressure within the at least one bellows 300 and to exert the biasing force 214. The bellows 300 may be secured in place by a plug 224, and the plug 224 may be threaded into the channel 210 to provide adjustability to the position of the bellows 300. The bellows 300 may be driven by the pressurized fluid 302. As used herein, "bellows" includes a pressurized bladder. The pressurized fluid 302 may enter the bellows 300 through an endplate 304 of the bellows 300. In one embodiment, a fluid channel 306 passes through the plug 224 and the endplate 304 into the bellows 300. The endplate 304 may be welded to the plug 224.

Referring to FIG. 4, in one embodiment, the biasing apparatus 206 includes at least one thrust piston 400 configured to translate toward the anti-rotation shroud dampening pin 100 in response to a pressurized fluid 302 and to exert the biasing force 214. A plug 224 may form a seal for the pressurized fluid 302 or may secure a seal for the pressurized fluid 302 in place. The thrust piston 400 includes a piston head 402, and may include a stanchion 404 attached to the piston head 402 and operating on the anti-rotation shroud dampening pin 100, or the piston head 402 may operate on the anti-rotation shroud dampening pin 100 directly without a stanchion 404 (not shown).

Referring to FIG. 5, in one embodiment, the biasing apparatus 206 includes a plug 224 disposed in the channel 210, a pin seal 502, and a pressurized cavity 500 disposed between the plug 224 and the anti-rotation shroud dampening pin 100. The plug 224 may form a seal for the pressurized fluid 302 in the pressurized cavity 500 or may secure a seal for the pressurized fluid 302 in place. The pressurized fluid 302 directly exerts the biasing force 214 on the shroud dampening pin 100. The pin seal 502 may be disposed on the cap 106, the shaft 102, the channel 210 adjacent to the cap 106, the channel 210 adjacent to the shaft 102, or a combination thereof.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A turbine shroud assembly, comprising:

an inner shroud arranged to be disposed adjacent to a hot gas path, the inner shroud including an anti-rotation depression, the anti-rotation depression including a depression non-circular cross-section; and an outer shroud adjacent to the inner shroud and arranged to be disposed distal from the hot gas path across the inner shroud, the outer shroud including a channel extending from an aperture adjacent to the inner shroud;

an anti-rotation shroud dampening pin disposed within the channel and in contact with the inner shroud, the anti-rotation shroud dampening pin including:

a shaft disposed within the channel;

an anti-rotation dampening tip disposed at a first end of the shaft and extending through the aperture into the anti-rotation depression of the inner shroud, the anti-rotation dampening tip including a pin non-circular cross-section; and a cap disposed at a second end of the shaft distal from the first end of the shaft; and a biasing apparatus in contact with the cap, the biasing apparatus providing a biasing force away from the outer shroud along the anti-rotation shroud dampening pin to the inner shroud through the anti-rotation dampening tip, wherein the pin non-circular cross-section mates non-rotatably into the depression non-circular cross-section.

2. The turbine shroud assembly of claim 1, wherein the cap includes an extraction interface.

3. The turbine shroud assembly of claim 2, wherein the extraction interface includes a threaded bore.

4. The turbine shroud assembly of claim 1, wherein the shaft includes a circumferential relief groove directly adjacent to the cap.

5. The turbine shroud assembly of claim 1, wherein the inner shroud includes a composition selected from the group consisting of ceramic matrix composites (CMC), aluminum oxide-fiber-reinforced aluminum oxides (Ox/Ox), carbon-fiber-reinforced silicon carbides (C/SiC), silicon-carbide-fiber-reinforced silicon carbides (SiC/SiC), carbon-fiber-reinforced silicon nitrides ($C/Si_3N_4$), silicon-carbide-fiber-reinforced silicon nitrides ($SiC/Si_3N_4$), superalloys, nickel-based superalloys, cobalt-based superalloys, INCONEL 718, INCONEL X-750, cobalt L-605, and combinations thereof.

6. The turbine shroud assembly of claim 1, wherein the anti-rotation shroud dampening pin includes a material composition selected from the group consisting of high alloy steels, CrMo steels, superalloys, nickel-based superalloys, cobalt-based superalloys, cobalt L-605, CRUCIBLE 422, INCONEL 718, INCONEL X-750, and combinations thereof.

7. The turbine shroud assembly of claim 1, further including a plurality of anti-rotation shroud dampening pins disposed within a plurality of channels.

8. The turbine shroud assembly of claim 1, wherein the biasing force is sufficient to dampen or eliminate contact and stresses between the inner shroud and the outer shroud generated by air loads and acoustic loads from the hot gas path during operation.

9. The turbine shroud assembly of claim 1, wherein the anti-rotation dampening tip inhibits circumferential motion of the inner shroud.

10. The turbine shroud assembly of claim 1, wherein the anti-rotation dampening tip inhibits rotation of the anti-rotation shroud dampening pin.

11. The turbine shroud assembly of claim 1, wherein the biasing apparatus includes a plug disposed in the channel, and a spring disposed in the channel between the plug and the cap, the plug compressing the spring, exerting the biasing force.

12. The turbine shroud assembly of claim 1, wherein the biasing apparatus is a springless biasing apparatus.

13. The turbine shroud assembly of claim 1, wherein the biasing apparatus is driven by a pressurized fluid.

14. The turbine shroud assembly of claim 13, wherein the biasing apparatus includes at least one bellows configured to expand in response to an increased internal pressure within the at least one bellows and to exert the biasing force.

15. The turbine shroud assembly of claim 13, wherein the biasing apparatus includes at least one thrust piston configured to exert the biasing force.

16. The turbine shroud assembly of claim 13, wherein the biasing apparatus includes a plug disposed in the channel, a pin seal, and a pressurized cavity disposed between the plug and the anti-rotation shroud dampening pin, and the pressurized fluid directly exerts the biasing force on the anti-rotation shroud dampening pin.

* * * * *